US010025208B2

(12) United States Patent
Maeda et al.

(10) Patent No.: US 10,025,208 B2
(45) Date of Patent: Jul. 17, 2018

(54) ELECTROPHOTOGRAPHIC PHOTORECEPTOR AND IMAGE FORMING APPARATUS

(71) Applicant: Konica Minolta, Inc., Tokyo (JP)

(72) Inventors: Seisuke Maeda, Fussa (JP); Kazuhiro Kuramochi, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/450,094

(22) Filed: Mar. 6, 2017

(65) Prior Publication Data

US 2017/0285496 A1 Oct. 5, 2017

(30) Foreign Application Priority Data

Apr. 5, 2016 (JP) ..... 2016-075871

(51) Int. Cl.

| | |
|---|---|
| ***G03G 5/043*** | (2006.01) |
| ***G03G 5/05*** | (2006.01) |
| ***G03G 5/087*** | (2006.01) |
| ***G03G 15/00*** | (2006.01) |

(52) U.S. Cl.

CPC ..... *G03G 5/043* (2013.01); *G03G 5/05* (2013.01); *G03G 5/0592* (2013.01); *G03G 5/087* (2013.01); *G03G 15/75* (2013.01)

(58) Field of Classification Search

CPC ..... G03G 5/043; G03G 5/087; G03G 5/0592; G03G 5/05; G03G 15/75

See application file for complete search history.

(56) References Cited

FOREIGN PATENT DOCUMENTS

| | | | |
|---|---|---|---|
| JP | 2013182240 | A | 9/2013 |
| JP | 2014085564 | A | 5/2014 |
| JP | 2014199391 | A | 10/2014 |
| JP | 2015099354 | A | 5/2015 |

OTHER PUBLICATIONS

Machine Translation of JP2013-182240, (JP2013-182240A, and JP2013-182240B).*

* cited by examiner

*Primary Examiner* — Thorl Chea
(74) *Attorney, Agent, or Firm* — Lucas & Mercanti, LLP

(57) ABSTRACT

An electrophotographic photoreceptor includes: a conductive support; and a photosensitive layer which contains an electric charge generating material and an electric charge transport material, wherein a layer configuring a surface of the electrophotographic photoreceptor contains a resin binder, and conductive particles A and B dispersed in the resin binder, the conductive particles A have a single peak and volume resistance ρ1, the conductive particles B have a single peak and volume resistance ρ2, when a particle diameter of the conductive particles A is set to d1, and a particle diameter of the conductive particles B is set to d2, Expression (1) is satisfied, and when the volume resistance of the conductive particles A is set to ρ1, and the volume resistance of the conductive particles B is set to ρ2, Expression (2) is satisfied:

$$4\times d2 \leq d1 \leq 20\times d2 \quad (1)$$

$$10\times \rho 1 < \rho 2 \quad (2).$$

8 Claims, 2 Drawing Sheets

ELECTROPHOTOGRAPHIC PHOTORECEPTOR AND IMAGE FORMING APPARATUS

The entire disclosure of Japanese Patent Application No. 2016-075871 filed on Apr. 5, 2016 including description, claims, drawings, and abstract are incorporated herein by reference in its entirety.

BACKGROUND OF THE INVENTION

Field of the Invention

The present invention relates to an electrophotographic photoreceptor and an image forming apparatus including the electrophotographic photoreceptor.

Description of the Related Art

In an electrophotographic image forming apparatus, in order to form an electrostatic latent image corresponding to an image to be formed, an electrophotographic photoreceptor (hereinafter, also simply referred to as a "photoreceptor") is used. In the electrophotographic image forming apparatus, first, a charged photoreceptor is irradiated with light, and thus, an electrostatic latent image is formed. Next, a toner is supplied onto the photoreceptor, and thus, a toner image corresponding to the electrostatic latent image is formed. Finally, the toner image is fixed onto a recording medium such as paper.

A contact type charging method using a charging roller or a charging brush (hereinafter, also simply referred to as a "roller charging system or the like"), a non-contact type charging method using a wire or the like (hereinafter, also simply referred to as a "scorotron charging system"), and the like are known as a charging method of the photoreceptor which is used in an electrophotographic system. In the roller charging system or the like, proximity discharge is used, and the degree of deterioration on the surface of the photoreceptor at the time of performing charging is large compared to a scorotron charging system. In the roller charging system or the like, a charged body such as an electron having high energy at the time of performing the proximity discharge collides with the surface of the photoreceptor, and thus, the photoreceptor is charged. At this time, the discharge of the photoreceptor is performed in a lamination direction of the photoreceptor, and thus, the photoreceptor deteriorates.

In a photoreceptor adopting the roller charging system or the like, a surface layer on which an ultraviolet ray curable resin reacts with an electric charge transport agent is disposed as the uppermost surface of the photoreceptor, and thus, electrical properties and strength are compatible (for example, refer to JP 2014-199391 A and JP 2015-099354 A). In addition, in order to make the electrical properties and the strength compatible, a photoreceptor of which a surface layer contains conductive particles is known (for example, refer to JP 2013-182240 A and JP 2014-085564 A). The conductive particles become a ground point of the discharge in the roller charging system or the like and become a deterioration position due to the discharge. For this reason, in order to reduce the deterioration position due to the discharge, it is effective that the surface layer contains conductive particles having a small powder resistance value and a large particle diameter.

However, in a case where the surface layer contains the conductive particles having a large particle diameter as with the photoreceptor disclosed in JP 2013-182240 A and JP 2014-085564 A, in the surface layer, a distance in which an electric charge is moved lengthens, and the electrical properties are defective. Accordingly, there is a case where a dot diameter of the electrostatic latent image increases, and thus, it is difficult to form a high-quality image. Thus, it is difficult to make the strength of the photoreceptor and the obtainment of the high-quality image compatible.

SUMMARY OF THE INVENTION

Therefore, a first object of the present invention is to provide an electrophotographic photoreceptor which has excellent abrasion resistance and is capable of forming a high-quality image. In addition, a second object of the present invention is to provide an image forming apparatus including the electrophotographic photoreceptor.

To achieve at least one of the abovementioned objects, according to an aspect, an electrophotographic photoreceptor reflecting one aspect of the present invention comprises: a conductive support; and a photosensitive layer which is disposed on the conductive support and contains an electric charge generating material and an electric charge transport material, wherein a layer configuring a surface of the electrophotographic photoreceptor contains a resin binder configuring the layer, conductive particles A dispersed in the resin binder, and conductive particles B dispersed in the resin binder, the conductive particles A have a single peak in a range of 80 nm to 200 nm in a particle size distribution based on the number of particles and volume resistance $\rho 1$ in a range of $10^1$ $\Omega$cm$\leq\rho 1<10^4$ $\Omega$cm, the conductive particles B have a single peak in a range of 10 nm to 30 nm in a particle size distribution based on the number of particles and volume resistance $\rho 2$ in a range of $10^6$ $\Omega$cm$<\rho 2\leq 10^9$ $\Omega$cm, when a particle diameter of the conductive particles A at the peak is set to d1, and a particle diameter of the conductive particles B at the peak is set to d2, Expression (1) described below is satisfied, and when the volume resistance of the conductive particles A is set to $\rho 1$, and the volume resistance of the conductive particles B is set to $\rho 2$, Expression (2) described below is satisfied:

$$4\times d2\leq d1\leq 20\times d2 \quad (1)$$

$$10\times\rho 1<\rho 2 \quad (2)$$

To achieve at least one of the abovementioned objects, according to an aspect, an image forming apparatus reflecting one aspect of the present invention comprises: the electrophotographic photoreceptor according to the aspect of the present invention; a charging device for charging the surface of the electrophotographic photoreceptor; an exposing device for forming an electrostatic latent image by irradiating the charged surface of the electrophotographic photoreceptor with light; a developing device for forming a toner image by supplying a toner onto the electrophotographic photoreceptor on which the electrostatic latent image is formed; and a transfer device for transferring the toner image on the surface of the electrophotographic photoreceptor onto a recording medium, wherein the charging device is a contact type charging device for applying a charged voltage by being in contact with the surface of the electrophotographic photoreceptor.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described in detail with reference to the drawings. However, the scope of the invention is not limited to the illustrated examples.

(Configuration of Image Forming Apparatus)

Figure 1:
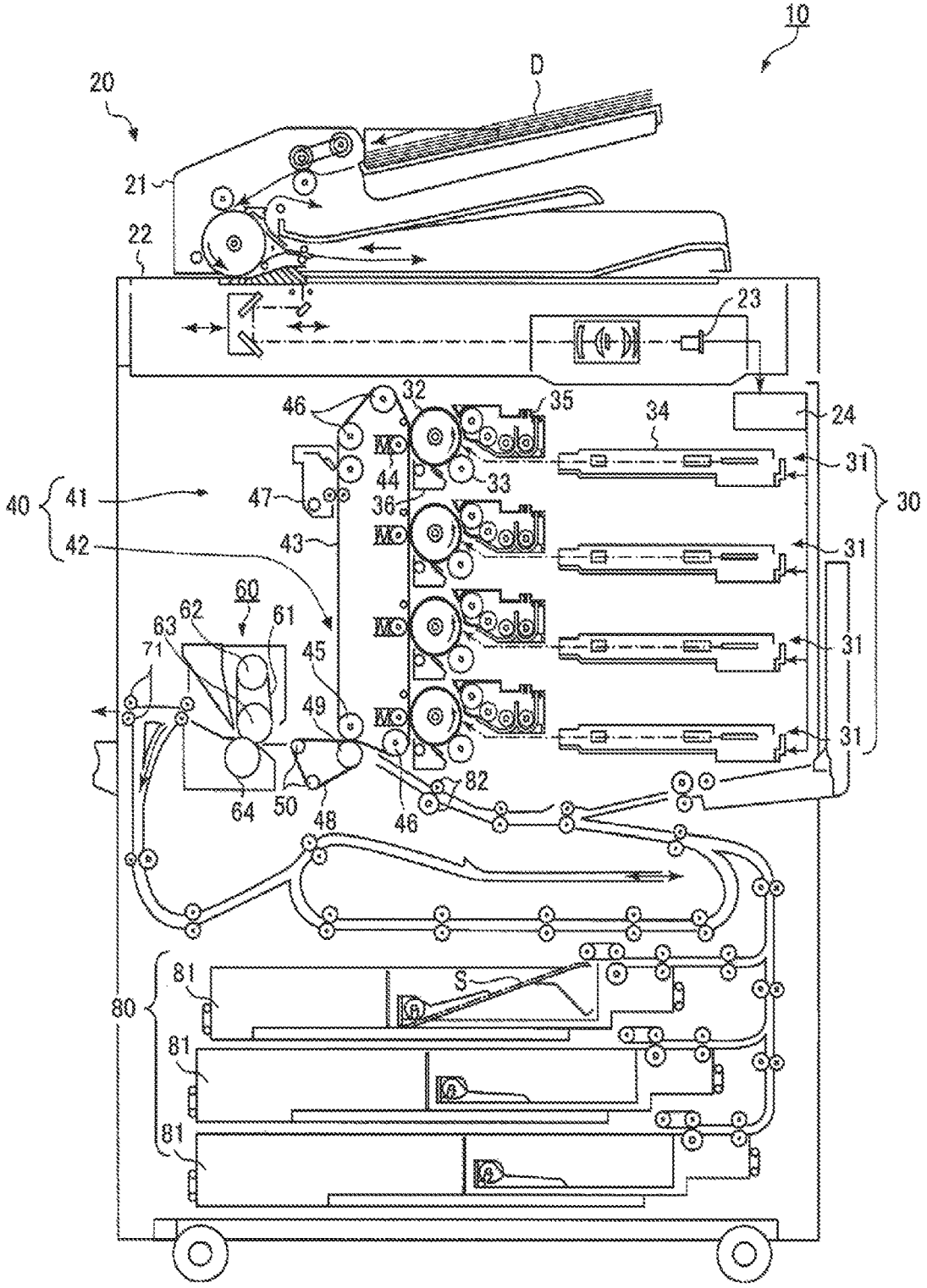
FIG. 1 is a diagram illustrating a configuration of an image forming apparatus according to an embodiment of the present invention.

FIG. 1 is a diagram illustrating a configuration of an image forming apparatus 10.

As illustrated in FIG. 1, the image forming apparatus 10 includes an image reading section 20, an image forming section 30, an intermediate transfer section 40, a fixing device 60, and a recording medium transport section 80. The same configuration as that of a known image forming apparatus can be used as the configuration of the image forming apparatus 10 except for the photoreceptor 32.

The image reading section 20 reads an image from a manuscript D, and obtains image data for forming an electrostatic latent image. The image reading section 20 includes a paper feeding device 21, a scanner 22, a CCD sensor 23, and an image processor 24.

The image forming section 30, for example, includes four image forming units 31 corresponding to each color of yellow, magenta, cyan, and black. The image forming unit 31 includes a photoreceptor (an electrophotographic photoreceptor) 32, a charging device 33, an exposing device 34, a developing device 35, and a cleaning device 36.

The photoreceptor 32 is a negative charge type organic photoreceptor having photoconductivity. The photoreceptor 32 is charged by the charging device 33. The charging device 33 is a contact type charging device in which the photoreceptor 32 is charged by being in contact with a contact charging member such as a charging roller or a charging brush, and for example, is a roller charging device in which the photoreceptor 32 is subjected to contact charge by a charging roller. In such a contact type charging device, proximity discharge occurs at the time of charging the photoreceptor 32. The proximity discharge acts on the surface of the photoreceptor 32, and thus, the photoreceptor 32 deteriorates. Therefore, in this embodiment, even in a case where the proximity discharge occurs, the deterioration of the photoreceptor 32 can be suppressed. One of the characteristics of this embodiment is the photoreceptor 32, and thus, the detailed description of the photoreceptor 32 will be described below.

The exposing device 34 forms the electrostatic latent image by irradiating the charged photoreceptor 32 with light. The exposing device 34, for example, is a semiconductor laser. The developing device 35 forms a toner image corresponding to the electrostatic latent image by supplying a toner onto the photoreceptor 32 on which the electrostatic latent image is formed. The developing device 35, for example, is a known developing device of an electrophotographic image forming apparatus. The cleaning device 36 removes a residual toner of the photoreceptor 32. Here, the "toner image" indicates a state where the toner is aggregated into the shape of an image.

A known toner can be used as the toner. The toner may be a one-component developer, or may be a two-component developer. The one-component developer is configured of toner particles. In addition, the two-component developer is configured of toner particles and carrier particles. The toner particles are configured of toner base particles and external additives such as silica which is attached onto the surface of the toner base particles. The toner base particles, for example, are configured of a binding resin, a colorant, and a wax.

The intermediate transfer section 40 includes a primary transfer unit 41 and a secondary transfer unit 42.

The primary transfer unit 41 includes an intermediate transfer belt 43, a primary transfer roller 44, a backup roller 45, a plurality of first support rollers 46, and a cleaning device 47. The intermediate transfer belt 43 is an endless belt. The intermediate transfer belt 43 is stretched by the backup roller 45 and the first support roller 46. At least one roller of the backup roller 45 and the first support roller 46 is rotatively driven, and thus, the intermediate transfer belt 43 travels on an endless track in one direction at a constant rate.

The secondary transfer unit 42 includes a secondary transfer belt 48, a secondary transfer roller 49, and a plurality of second support rollers 50. The secondary transfer belt 48 is an endless belt. The secondary transfer belt 48 is stretched by the secondary transfer roller 49 and the second support roller 50.

The fixing device 60 includes a fixing belt 61, a heating roller 62, a first pressure roller 63, a second pressure roller 64, a heater, a temperature sensor, an air separator, a guide plate, and a guide roller.

In the fixing belt 61, abase layer, an elastic layer, and a release layer are laminated in this order. The fixing belt 61 is pivotally supported by the heating roller 62 and the first pressure roller 63 in a state where the base layer is disposed on the inside and the release layer is disposed on the outside.

The heating roller 62 includes a rotatable aluminum sleeve, and a heater disposed in the sleeve. The first pressure roller 63, for example, includes a rotatable core, and an elastic layer disposed on outer peripheral surface of the rotatable core.

The second pressure roller 64 is disposed to face the first pressure roller 63 through the fixing belt 61. The second pressure roller 64 is disposed to be freely close to or to be freely separated from the first pressure roller 63, and when the second pressure roller 64 is close to the first pressure roller 63, the second pressure roller 64 presses the elastic layer of the first pressure roller 63 through the fixing belt 61, and thus, forms a fixing nip portion which is a contact portion with respect to the fixing belt 61.

The air separator is a device for accelerating the separation of a recording medium S from the fixing belt 61 by generating an air stream towards the fixing nip portion from the downstream side of the fixing belt 61 in a movement direction.

The guide plate is a member for guiding the recording medium S having an unfixed toner image to the fixing nip portion. The guide roller is a member for guiding the recording medium onto which the toner image is fixed to the outside of the image forming apparatus 10 from the fixing nip portion.

The recording medium transport section 80 includes three paper feeding tray units 81 and a plurality of resist roller pairs 82. In the paper feeding tray unit 81, the recording mediums (in this embodiment, specification paper, specialized paper, and the like) S, which are distinguished on the basis of a weight, a size, or the like, are contained according to the type set in advance. The resist roller pair 82 is disposed to form a desired transport path.

In such an image forming apparatus 10, first, the electrostatic latent image is formed by irradiating the charged photoreceptor 32 with light, and then, the toner image corresponding to the electrostatic latent image is formed by supplying the toner onto the photoreceptor 32. In intermediate transfer section 40, the toner image is transferred onto the recording medium S which has been transported by the recording medium transport section 80. The toner image which is transferred onto the recording medium S in the intermediate transfer section 40 is fixed onto the recording medium S in the fixing device 60. The recording medium onto which the toner image is fixed is guided towards the outside of the image forming apparatus 10 by the guide roller 71.

(Configuration of Photoreceptor)

Figure 2:
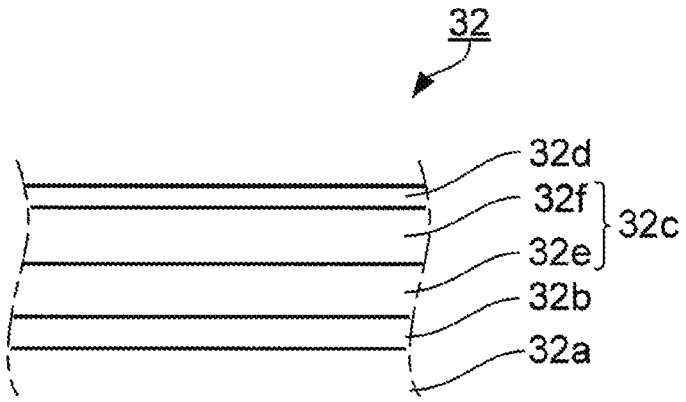
FIG. 2 is a partial sectional view of a photoreceptor according to an embodiment of the present invention.

Next, the photoreceptor 32 will be described in detail. FIG. 2 is a partial sectional view of the photoreceptor 32.

As illustrated in FIG. 2, the photoreceptor 32 includes a conductive support 32*a*, an interlayer 32*b*, a photosensitive layer 32*c* which is disposed on the conductive support 32*a* and contains an electric charge generating material and an electric charge transport material, and a surface layer 32*d* which is disposed on the photosensitive layer 32*c*. That is, in this embodiment, the "layer configuring the surface of the electrophotographic photoreceptor" is the surface layer 32*d*. In addition, the photosensitive layer 32*c* may be a single layer containing an electric charge transport substance and an electric charge generating substance, or may have a two-layer structure including an electric charge generating layer containing an electric charge generating substance and an electric charge transport layer containing an electric charge transport substance. In this embodiment, the photosensitive layer 32*c* has a two-layer structure including an electric charge generating layer 32*e*, and an electric charge transport layer 32*f* which is disposed on the electric charge generating layer 32*e*. The photosensitive layer 32*c* may have the same configuration as that of a known organic photoreceptor except for the surface layer 32*d*.

The conductive support 32*a* is a member which supports the photosensitive layer 32*c* through the interlayer 32*b* and has conductivity. Examples of the type of conductive support 32*a* include a metal drum, a metal sheet, a plastic film on which a metal foil is laminated, a plastic film on which a conductive substance is subjected to vapor deposition, a metal member or a plastic film on which a coating material containing a conductive substance is applied, paper, and the like. The type of metal is not particularly limited insofar as having conductivity. Examples of the type of metal include aluminum, copper, chromium, nickel, zinc, and stainless steel. In addition, examples of the conductive substance include metal, indium oxide, and tin oxide. In this embodiment, the conductive support 32*a* is an aluminum drum. In addition, the thickness of a peripheral wall of the conductive support 32*a*, for example, is 0.1 mm.

The interlayer 32*b* is a layer having a barrier function and an adhesive function of the conductive support 32*a*. The interlayer 32*b*, for example, contains a resin binder for the interlayer 32*b*, and conductive particles which are dispersed in the resin binder for the interlayer 32*b*. The thickness of the interlayer 32*b*, for example, is 0.1 μm to 15 μm, and is more preferably 0.3 μm to 10 μm.

Examples of the resin binder for the interlayer 32*b* include casein, polyvinyl alcohol, nitrocellulose, an ethylene-acrylic acid copolymer, polyamide, polyurethane, and gelatin. In addition, examples of the conductive particles include metal oxide particles such as alumina, zinc oxide, titanium oxide, tin oxide, antimony oxide, indium oxide, and bismuth oxide, and ultrafine particles such as indium oxide doped with tin, tin oxide doped with antimony, and zirconium oxide. The interlayer 32*b*, for example, is prepared by a dip coating method of dipping the conductive support 32*a* in a solution of the resin binder for the interlayer 32*b* in which the conductive particles are dispersed.

The photosensitive layer 32*c* is a layer for forming an electrostatic latent image of a desired image on the surface thereof in the image forming apparatus 10 described above. In this embodiment, the photosensitive layer 32*c* includes the electric charge generating layer 32*e* and the electric charge transport layer 32*f*.

The electric charge generating layer 32*e*, for example, contains a resin binder for the electric charge generating layer 32*e*, and electric charge generating substances which are dispersed in the resin binder for the electric charge generating layer 32*e*. The thickness of the electric charge generating layer 32*e* is not particularly limited, but the thickness of the electric charge generating layer 32*e*, for example is in a range of 0.01 μm to 5 μm, and is more preferably in a range of 0.05 μm to 3 μm.

Examples of the resin binder for the electric charge generating layer 32*e* include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenolic resin, a polyester resin, an alkyd resin, a polycarbonate resin, a silicone resin, a melamine resin, a copolymer resin containing two or more resins described above (for example, a vinyl chloride-vinyl acetate copolymer resin and a vinyl chloride-vinyl acetate-maleic anhydride copolymer resin), and a poly-vinyl carbazole resin. Examples of the electric charge generating substance include an azo raw material such as Sudan Red or Diane Blue, a quinone pigment such as pyrene quinone or anthanthrone, a quinocyanine pigment, a perylene pigment, an indigo pigment such as indigo or thioindigo, and a phthalocyanine pigment. The electric charge generating layer 32*e*, for example, is prepared by a dip coating method of dipping the conductive support 32*a* on which the interlayer 32*b* is formed in a solution of the resin binder for the electric charge generating layer 32*e* in which the electric charge generating substances are dispersed.

Examples of the electric charge generating substance include an azo raw material such as Sudan Red or Diane Blue, a quinone pigment such as pyrene quinone or anthanthrone, a quinocyanine pigment, a perylene pigment, an indigo pigment such as indigo and thioindigo, a phthalocyanine pigment, and the like. In addition, the substances described above may be independently used, or two or more types thereof may be used in combination, as the electric charge generating substance.

The electric charge transport layer 32*f* contains a resin binder for the electric charge transport layer 32*f*, and electric charge transport substances which are dispersed in the resin binder for the electric charge transport layer 32*f*. The thickness of the electric charge transport layer 32*f*, for example, is 5 μm to 40 μm, and is more preferably 10 μm to 30 μm.

The resin binder for the electric charge transport layer 32*f* is a thermoplastic resin or a thermosetting resin. Examples of the resin binder for the electric charge transport layer 32*f* include polystyrene, an acrylic resin, a methacrylic resin, a vinyl chloride resin, a vinyl acetate resin, a polyvinyl butyral resin, an epoxy resin, a polyurethane resin, a phenolic resin, a polyester resin, an alkyd resin, a polycarbonate resin, a silicone resin, and a melamine resin. In addition, the resin binder for the electric charge transport layer 32*f* may be a copolymer containing two or more types of repeating unit structures of the resin binder for the electric charge transport layer 32*f* described above. Furthermore, it is preferable that the resin binder for the electric charge transport layer 32*f* is a polycarbonate resin which has a low water absorption rate and strong mechanical strength.

The electric charge transport layer 32*f*, for example, is prepared by a dip coating method of dipping the conductive support 32*a* on which the electric charge generating layer 32*e* is formed in a solution of the resin binder for the electric charge transport layer 32*f* in which the electric charge transport substances are dispersed, or is prepared by applying the solution of the resin binder for the electric charge transport layer 32*f* in which the electric charge transport substances are dispersed onto the electric charge generating layer 32*e*, and by drying the solution.

Examples of the electric charge transport substance include 4,4'-dimethyl-4"-(β-phenyl styryl) triphenyl amine, or compounds represented by CTM-1 to CTM-10.

[Chemical Formula 1]

CTM-1

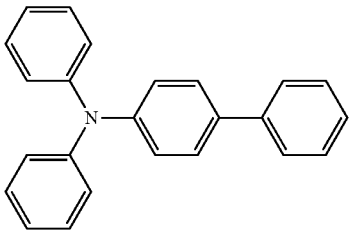

CTM-2

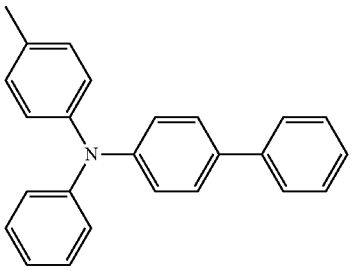

CTM-3

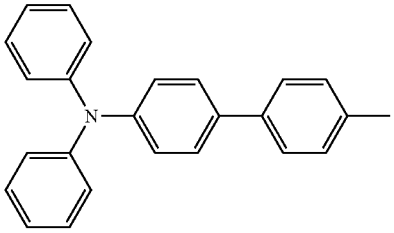

CTM-4

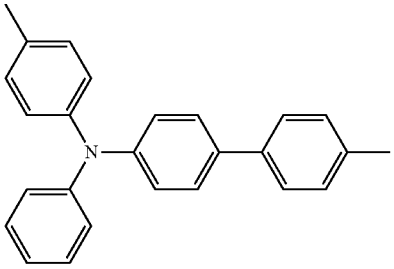

-continued

CTM-5

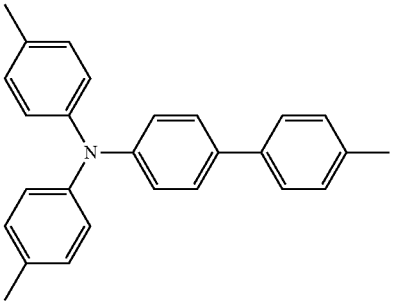

CTM-6

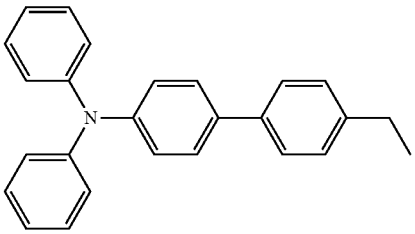

CTM-7

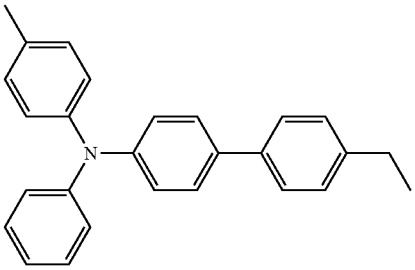

CTM-8

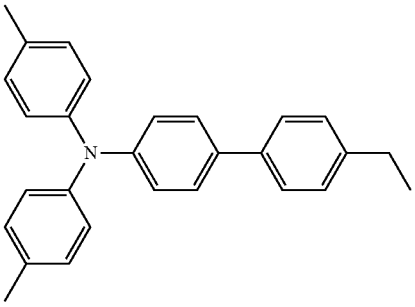

CTM-9

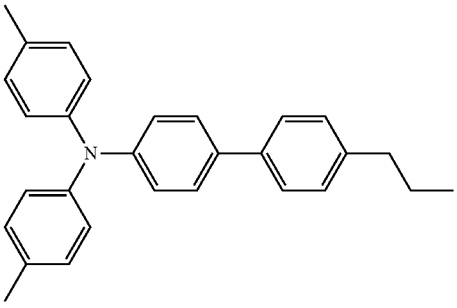

-continued

CTM-10

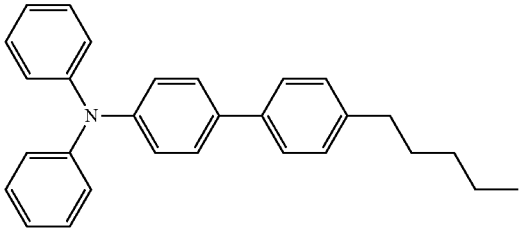

The surface layer 32*d* contains conductive particles A described below and conductive particles B described below. The surface layer 32*d* may have the same configuration as that of a known surface layer except that the surface layer 32*d* contains the conductive particles A and the conductive particles B. The surface layer 32*d* is disposed on the photosensitive layer 32*c*, and protects the photosensitive layer 32*c*. The photoreceptor 32 includes the surface layer 32*d*, and thus, the roughness and the uneven abrasion of the photoreceptor 32 are suppressed, and the deterioration of a formed image due to a cleaning failure is prevented. The surface layer 32*d* contains a resin binder for the surface layer 32*d*, the conductive particles A which are dispersed in the resin binder for the surface layer 32*d*, and the conductive particles B which are dispersed in the resin binder for the surface layer 32*d*. When a particle diameter of the conductive particles A is set to d1, and a particle diameter of the conductive particles B is set to d2, Expression (1) described below is satisfied. In addition, when the volume resistance of the conductive particles A is set to ρ1, and the volume resistance of the conductive particles B is set to ρ2, Expression (2) described below is satisfied:

$$4\times d2\leq d1\leq 20\times d2 \quad (1)$$

$$10\times\rho1<\rho2 \quad (2)$$

The resin binder for the surface layer 32*d* configuring the surface layer 32*d* may be a cured material of the thermoplastic resin described above, or may be a cured material of the thermosetting resin described above. In addition, the resin binder for the surface layer 32*d* configuring the surface layer 32*d* may be a set of polymerization cured materials (a set of polymers) obtained by polymerizing a polymerizable compound.

The polymerizable compound configuring the polymerization cured material, for example, is a compound having two or more radical polymerizable functional groups. The radical polymerizable functional group, for example, is a vinyl group, an acryloyl group, a methacryloyl group, and the like. That is, the surface layer 32*d* is configured of an integrated polymer obtained by performing radical polymerization with respect to a monomer having a radical polymerizable functional group.

The polymerizable compound, for example, is compounds of M1 to M15 described below.

[Chemical Formula 2]

M1

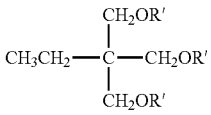

-continued

M2

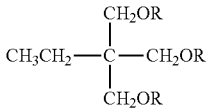

M3

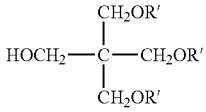

M4

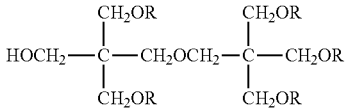

M5

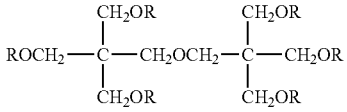

M6

$CH_3CH_2C-(CH_2OC_3H_6OR)_3$

M7

$CH_3CH_2C-(CH_2CH_2OR)_3$

[Chemical Formula 3]

M8

$R-(OC_3H_6)_3-OR$

M9

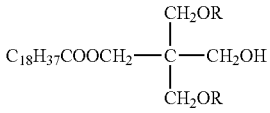

M10

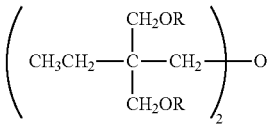

M11

$(ROCH_2)_4C$

M12

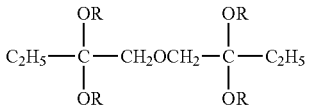

M13

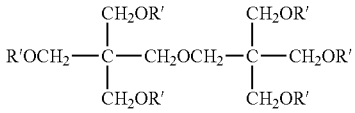

M14

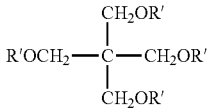

M15

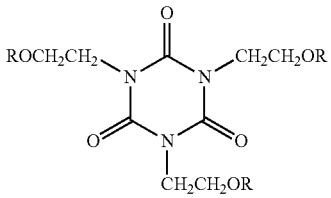

The conductive particles function as a ground point at the time of performing discharge, and become a route in which the electric charge is moved. Here, in this embodiment, the "conductive particles" indicate particles having volume resistance ρ in a range of $10^1$ Ωcm<ρ≤$10^9$ Ωcm. Examples of the conductive particles include metal oxide particles of tin oxide, zinc oxide, titanium oxide, antimony oxide, iridium oxide, bismuth oxide, and the like. Furthermore, it is preferable that the conductive particles are tin oxide from the viewpoint of easily adjusting the volume resistance.

The conductive particles has a peak in a range of 80 nm to 200 nm in a particle size distribution based on the number of particles and in a range of 10 nm to 30 nm in the particle size distribution based on the number of particles. Here, the "peak" indicates the highest point on a curved line in the particle size distribution based on the number of particles. In addition, the value of the peak may be a catalog value, or may be an actual measurement value. A curved line in the particle size distribution of the conductive particles A and a curved line in the particle size distribution of the conductive particles B may partially overlap with each other, but it is preferable that the curved lines are separated from each other. Here, the "curved line in the particle size distribution of the conductive particles A and the curved line in the particle size distribution of the conductive particles B are separated from each other" indicates that the baseline exists between the curved line in the particle size distribution of the conductive particles A and the curved line in the particle size distribution of the conductive particles B. The conductive particles, for example, can be prepared by mixing particles having a peak in a range of 80 nm to 200 nm and particles having a peak in a range of 10 nm to 30 nm.

In this embodiment, two types of conductive particles having different particle diameters and powder resistances (the conductive particles A and the conductive particles B) are used. The same type of conductive particles may be used as the conductive particles A and the conductive particles B, or different types of conductive particles may be respectively used as the conductive particles A and the conductive particles B. In this embodiment, tin oxide ($SnO_2$) is used as both of the conductive particles A and the conductive particles B.

In the surface layer 32*d*, the conductive particles A become the ground point at the time of performing discharge. The conductive particles A have a single peak in a range of 80 nm to 200 nm, in a particle size distribution based on the number of particles. In addition, it is preferable that the particle size distribution of the conductive particles A based on the number of particles is positioned in a range of 80 nm to 200 nm. Here, the "particle size distribution based on the number of particles is positioned in a predetermined range" indicates that a contact point between the curved line in the particle size distribution and the baseline is positioned in a predetermined range. That is, it is preferable that a minimum particle diameter of the conductive particles A is greater than 80 nm, and it is preferable that a maximum particle diameter of the conductive particles A is less than or equal to 200 nm. In a case where the minimum particle diameter of the conductive particles A is less than or equal to 80 nm, there is a concern that the conductive particles A do not function as the ground point at the time of performing discharge. In contrast, in a case where the maximum particle diameter of the conductive particles A is greater than 200 nm, there is a concern that the effect as the ground point at the time of performing discharge is saturated.

The conductive particles B have a single peak in a range of 10 nm to 30 nm, in a particle size distribution based on the number of particles. In addition, it is preferable that the particle size distribution of the conductive particles B based on the number of particles is positioned in a range of 10 nm to 30 nm. That is, it is preferable that a minimum particle diameter of the conductive particles B is greater than 10 nm, and it is preferable that a maximum particle diameter of the conductive particles B is less than or equal to 30 nm. In a case where the minimum particle diameter of the conductive particles B is less than 10 nm, there is a concern that conductivity is not exhibited. In contrast, in a case where the maximum particle diameter of the conductive particles B is greater than 30 nm, there is a concern that the conductive particles B function as the ground point at the time of performing discharge. In a case where the volume resistance of the conductive particles B is less than $10^6$, there is a concern that the conductive particles B function as the ground point at the time of performing discharge, and thus, it is not possible to suppress the deterioration due to the discharge. In contrast, in a case where the volume resistance of the conductive particles B is greater than $10^9$, there is a concern that the conductivity is not exhibited.

In addition, as described above, a particle diameter d1 of the conductive particles A at the peak and a particle diameter d2 of the conductive particles B at the peak satisfy Expression (1) described below.

$$4\times d2 \le d1 \le 20\times d2 \quad (1)$$

In a case where the conductive particles A and the conductive particles B do not satisfy Expression (1) described above, a difference between the particle diameter d1 of the conductive particles A at the peak and the particle diameter d2 of the conductive particles B at the peak decreases, and thus, there is a case where it is not possible to obtain a high-quality image.

The conductive particles A and the conductive particles B in a state before being contained in the surface layer 32*d*, for example, are classified, and thus, can be adjusted to have a single peak in the range described above. In addition, in the state of the photoreceptor 32, the particle diameter d1 of the conductive particles A and the particle diameter d2 of the conductive particles B, for example, can be measured by the following method. A segment of 1 mm×1 mm is cut out from the surface layer of the photoreceptor 32 by a cutter. Next, the cut-out segment is embedded in an embedding resin, and a sample for electronic microscope observation having a thickness of 100 nm is prepared by an ultramicrotome (Leica EM UC7; manufactured by Leica Microsystems, Inc.). Finally, in the prepared sample, a particle diameter is measured from a transmission electron image having a magnification of 15000 by using a transmissive electronic microscope (JEM-2000FX; manufactured by JEOL Ltd.).

In addition, the volume resistance ρ1 of the conductive particles A is in a range of $10^1$ Ωcm≤ρ1<$10^4$ Ωcm. In a case where the volume resistance of the conductive particles A is less than $10^1$, there is a concern that the conductive particles A do not function as the ground point at the time of performing discharge. In contrast, in a case where the volume resistance of the conductive particles A is greater than $10^4$, there is a concern that it is not possible to ensure electrical properties as the surface layer 32*d*.

In addition, the volume resistance ρ2 of the conductive particles B is in a range of $10^6$ Ωcm<ρ2≤$10^9$ Ωcm. In a case where the volume resistance of the conductive particles B is less than $10^6$, there is a concern that the film resistance of the surface layer 32*d* decreases, and thus, it is not possible to form an electrostatic latent image. In contrast, in a case where the volume resistance of the conductive particles A is greater than $10^9$, there is a concern that it is not possible to ensure the electrical properties as that surface layer 32*d*.

The volume resistance (the powder resistance) pin the photoreceptor 32, for example, can be measured by only bringing a probe attached to a resistivity meter (Loresta GXM CP-T700; manufactured by Mitsubishi Chemical Analytech Co., Ltd.) into contact with the surface layer 32*d* of the photoreceptor 32. In addition, as described above, in the photoreceptor 32, the surface layer 32*d* having conductivity is disposed on the electric charge transport layer 32*f*, and thus, the electric charge transport layer 32*f* has extremely high insulating properties compared to the surface layer 32*d*. Accordingly, in a case where it is assumed that the surface resistance of the photoreceptor 32 is measured, a conductive path of a current at the time of applying the current is only the surface layer 32*d*, and energization is performed only between probe needles, volume resistance can be obtained from the surface resistance on the basis of the thickness of the surface layer 32*d*, and a distance between the probe needles, and a probe width.

In addition, it is preferable that a number density of the conductive particles A in the surface layer 32*d* of the photoreceptor 32 is in a range of 1 item/$\mu m^3$ to 150 items/$\mu m^3$, and it is preferable that a number density of the conductive particles B in the surface layer 32*d* of the photoreceptor 32 is in a range of 100 items/$\mu m^3$ to 70000 items/$\mu m^3$. In a case where the number density of the conductive particles A and the number density of the conductive particles B are in the range described above, as described in examples, abrasion resistance, electrical properties, and dot reproducibility are excellent.

In a method of measuring the number density, a segment having a length of 1 mm×a width of 1 mm×a height (a depth) of 100 nm is cut out by a cutter at a position of 60 mm from an end portion of the photoreceptor 32. Thus, the cut out of the segment is repeated 10 times at the same position by changing the depth, and thus, ten segments are cut out. Accordingly, a sample having a depth of 1 μm can be obtained. In a transmission electron image having a magnification of 15000, the number of conductive particles A and the number of conductive particles B within the visual field of 1 μm×1 μm are respectively counted with respect to ten cut-out segments. The total number of particles of ten segments becomes a number density per 1 $\mu m^3$. The step described above is performed at each of a position of 180 mm from the end portion of the photoreceptor 32 and a position of 300 mm from the end portion of the photoreceptor 32. Finally, a value which is obtained by averaging the calculated number densities at the position of 60 mm, the position of 180 mm, and the position of 300 mm is set to the number density of the conductive particles A and the conductive particles B. Furthermore, only one segment is cut out at each of the positions, and the measured number of particles may be multiplied by 10, and thus, may be set to the number density of the conductive particles A and the conductive particles B at the position.

The number density can be adjusted according to a formulation amount of each of the conductive particles A or the conductive particles B with respect to the resin binder for the surface layer 32*d*.

It is preferable that the total formulation amount of the conductive particles A and the conductive particles B in the surface layer 32*d* is in a range of 50 parts by mass to 250 parts by mass, with respect to 100 parts by mass of the resin binder for the surface layer 32*d*. In a case where the total formulation amount of the conductive particles A and the conductive particles B in the surface layer 32*d* is less than 50 parts by mass with respect to 100 parts by mass of the resin binder for the surface layer 32*d*, there is a concern that the ground point of the discharge decreases, and the electric charge is not suitably moved. In contrast, in a case where the total formulation amount of the conductive particles A and the conductive particles B in the surface layer 32*d* is greater than 250 parts by mass with respect to 100 parts by mass of the resin binder for the surface layer 32*d*, there is a concern that the ground point of the discharge increases, the abrasion resistance is defective, and the mobility of the electric charge is saturated.

Furthermore, the total proportion of the conductive particles A and the conductive particles B with respect to 100 parts by mass of the resin binder for the surface layer 32*d* can be obtained by the number density. As a specific numerical value, it is preferable that the conductive particles A are in a range of 50 parts by mass to 350 parts by mass with respect to 100 parts by mass of the resin binder for the surface layer 32*d*. In addition, it is preferable that the conductive particles B are in a range of 50 parts by mass to 350 parts by mass with respect to 100 parts by mass of the resin binder for the surface layer 32*d*. In addition, a formulation proportion of the conductive particles A and the conductive particles B is preferably 90:10 to 10:90, and is more preferably 70:30 to 30:70.

In addition, the conductive particles A and the conductive particles B may include a layer which is configured of a residue of a surfactant having a crosslinkable reactive group. Here, the "residue of the surfactant having a crosslinkable reactive group" indicates a structure between the conductive particles A and the conductive particles B, and the resin binder for the surface layer 32*d*, which is chemically bonded to metal oxide particles and is chemically bonded to the resin binder for the surface layer 32*d*.

The particle diameter d1 of the conductive particles A and the particle diameter d2 of the conductive particles B, which are not subjected to a surface treatment, can be identified with the particle diameter d1 of the conductive particles A and the particle diameter d2 of the conductive particles B, which are subjected to the surface treatment.

The conductive particles A and the conductive particles B are subjected to the surface treatment with the surfactant radical having a polymerizable functional group, and thus, a radical polymerizable functional group is introduced into the surface. The conductive particles A and the conductive particles B are subjected to the surface treatment with the surfactant, and thus, in a forming step of the surface layer 32*d* in a manufacturing process of the photoreceptor 32, the conductive particles A and the conductive particles B are capable of forming a crosslinked structure by reacting with a radical polymerizable compound, and the film strength of the electric charge transport layer 32*f* can be sufficiently obtained. In addition, high dispersibility of the conductive particles A and the conductive particles B in a coated film can be obtained.

Examples of the radical polymerizable functional group of the surfactant include a vinyl group, an acryloyl group, a methacryloyl group, and the like. Such a radical polymerizable functional group reacts with the radical polymerizable compound forming a resin binder, and thus, is capable of forming the surface layer 32*d* having high film strength. A silane coupling agent having a polymerizable functional group, such as a vinyl group, an acryloyl group, and a methacryloyl group, is preferable as the surfactant having a radical polymerizable functional group.

Examples of the surfactant include compounds represented by S-1 to S-36 in Table 1.

TABLE 1

| Surfactant No. | Surfactant |
|---|---|
| S-1 | $CH_2{=}CHSi(CH_3)(OCH_3)_2$ |
| S-2 | $CH_2{=}CHSi(OCH_3)_3$ |
| S-3 | $CH_2{=}CHSiCl_3$ |
| S-4 | $CH_2{=}CHCOO(CH_2)_2\ Si(CH_3)(OCH_3)_2$ |
| S-5 | $CH_2{=}CHCOO(CH_2)_2\ Si(OCH_3)_3$ |
| S-6 | $CH_2{=}CHCOO(CH_2)_2\ Si(OC_2H_5)\ (OCH_3)_2$ |
| S-7 | $CH_2{=}CHCOO(CH_2)_3\ Si(OCH_3)_3$ |
| S-8 | $CH_2{=}CHCOO(CH_2)_2\ Si(CH_3)Cl_2$ |
| S-9 | $CH_2{=}CHCOO(CH_2)_2\ SiCl_3$ |
| S-10 | $CH_2{=}CHCOO(CH_2)_3\ Si(CH_3)Cl_2$ |
| S-11 | $CH_2{=}CHCOO(CH_2)_3\ SiCl_3$ |
| S-12 | $CH_2{=}C(CH_3)COO(CH_2)_2\ Si(CH_3)(OCH_3)_2$ |
| S-13 | $CH_2{=}C(CH_3)COO(CH_2)_2\ Si(OCH_3)_3$ |
| S-14 | $CH_2{=}C(CH_3)COO(CH_2)_3\ Si(CH_3)(OCH_3)_2$ |
| S-15 | $CH_2{=}C(CH_3)COO(CH_2)_3\ Si(OCH_3)_3$ |
| S-16 | $CH_2{=}C(CH_3)COO(CH_2)_2\ Si(CH_3)Cl_2$ |
| S-17 | $CH_2{=}C(CH_3)COO(CH_2)_2\ SiCl_3$ |
| S-18 | $CH_2{=}C(CH_3)COO(CH_2)_3\ Si(CH_3)Cl_2$ |
| S-19 | $CH_2{=}C(CH_3)COO(CH_2)_3\ SiCl_3$ |
| S-20 | $CH_2{=}CHSi(C_2H_5)(OCH_3)_2$ |
| S-21 | $CH_2{=}C(CH_3)Si(OCH_3)_3$ |
| S-22 | $CH_2{=}C(CH_3)Si(OC_2H_5)_3$ |
| S-23 | $CH_2{=}CHSi(OCH_3)_3$ |
| S-24 | $CH_2{=}C(CH_3)Si(CH_3)(OCH_3)_2$ |
| S-25 | $CH_2{=}CHSi(CH_3)Cl_2$ |
| S-26 | $CH_2{=}CHCOOSi(OCH_3)_3$ |
| S-27 | $CH_2{=}CHCOOSi(OC_2H_5)_3$ |
| S-28 | $CH_2{=}C(CH_3)COOSi(OCH_3)_3$ |
| S-29 | $CH_2{=}C(CH_3)COOSi(OC_2H_5)_3$ |
| S-30 | $CH_2{=}C(CH_3)COO(CH_2)_3\ Si(OC_2H_5)_3$ |
| S-31 | $CH_2{=}CHCOO(CH_2)_2\ Si(CH_3)_2(OCH_3)$ |
| S-32 | $CH_2{=}CHCOO(CH_2)_2\ Si(CH_3)(OCOCH_3)_2$ |
| S-33 | $CH_2{=}CHCOO(CH_2)_2\ Si(CH_3)(ONHCH_3)_2$ |
| S-34 | $CH_2{=}CHCOO(CH_2)_2\ Si(CH_3)(OC_6H_5)_2$ |
| S-35 | $CH_2{=}CHCOO(CH_2)_2\ Si(C_{10}H_{21})(OCH_3)_2$ |
| S-36 | $CH_2{=}CHCOO(CH_2)_2\ Si(CH_2C_6H_5)(OCH_3)_2$ |

It is preferable that a film thickness of the surface layer 32*d* is in a range of 1.5 μm to 5.0 μm. In a case where the film thickness of the surface layer 32*d* is less than 1.5 μm, there is a concern that the surface layer 32*d* does not function as the surface layer 32*d*. In contrast, in a case where the film thickness of the surface layer 32*d* is greater than 5.0 μm, there is a concern that coating unevenness occurs at the time of forming the surface layer 32*d*, and image unevenness occurs at the time of forming an image. In addition, there is a concern that the electrical properties of the surface layer 32*d* deteriorate.

Furthermore, as described above, the photoreceptor 32 according to this embodiment includes the conductive support 32*a*, the interlayer 32*b*, the photosensitive layer 32*c*, and the surface layer 32*d*. However, the photoreceptor 32 may not include the surface layer 32*d*. In this case, the "layer configuring the surface of the electrophotographic photoreceptor" is a photosensitive layer. In addition, the photoreceptor 32 may not include the interlayer 32*b*.

Here, the function of the conductive particles A and the conductive particles B in the surface layer 32*d* will be described. It is known that conductive particles for imparting mechanical strength to a cured film using a photopolymerization reaction are added to the surface layer in order to have resistance to the discharge. It is necessary for oxide particles to have electrical properties, and thus, the oxide particles have conductivity. In the discharge at the time of performing charging in the roller charging system or the like, a charged body follows the easiest path. In this case, in a case of comparing the cured film with the conductive particles, the conductive particles overwhelmingly easily pass through the charged body, and easily becomes the ground point at the time of performing discharge. The electric charge is concentrated on the ground point, and thus, the surface layer considerably deteriorates, and the abrasion resistance of the photoreceptor extremely decreases.

In order to reduce the ground point while maintaining the electrical properties, a method of adding conductive particles having a large particle diameter is used. However, in this case, the number of conductive particles is reduced, and thus, in order to maintain the electrical properties, it is necessary to decrease the powder resistance of the conductive particles and to ensure the electrical properties as the surface layer. In such a surface layer, dots are easily scattered at the time of forming a latent image, and thus, it is difficult to forma delicate image. This is because in a case where the charged body is moved between the conductive particles in a horizontal direction, a diffusion distance of the dots lengthens. Adding an electric charge transport agent, which is an organic compound, is known as a suggestion for improving the electrical properties in such a surface layer. In discharge deterioration, a chemical bonding is broken by discharge energy in an organic substance, and thus, the film strength decreases.

In order to solving such problems, it is necessary to fill a gap between the conductive particles having a large particle diameter with particles having strength greater than that of the organic compound and a certain degree of electrical properties. Here, in a case where two types of conductive particles having different particle diameters are used in combination, an important point is to set the powder resistance of each of the conductive particles to a different value. As described above, the charged body at the time of performing discharge is easily flown to conductive particles having small powder resistance. Furthermore, even though the particle diameters are different from each other, in a case where the conductive particles have the same degree of powder resistance, the charged body at the time of performing discharge is evenly moved to the conductive particles regardless of the magnitude of the particle diameter, and in the deterioration at the time of performing discharge, an advantage of using conductive particles having a large diameter is reduced.

Thus, in the surface layer containing the conductive particles having different particle diameters, in order to reduce the ground point and to preferentially move charged particles, the resistance of particles having a large diameter (the conductive particles A) decreases, and the resistance of particles having a small diameter (the conductive particles B) increases, and thus, it is possible to exhibit deterioration resistance in the discharge while reducing a discharge portion. In addition, a gap between the particles having a large particle diameter is filled with particles having high resistance, and thus, it is possible to suppress the movement of the electric charge between particles having low resistance and a large diameter, and to form a delicate dot image.

EXAMPLES

Hereinafter, the present invention will be described in more detail by using examples, but the present invention is not limited thereto.

1. Preparation of Photoreceptor

<Preparation of Photoreceptor of No. 1>

(1) Preparation of Conductive Support

The surface of a drum-like aluminum support (an outer diameter of φ30 mm and a length of 360 mm) was subjected to cutting work, and a conductive support having surface roughness Rz of 1.5 μm was prepared.

(2) Formation of Interlayer

Next, components described below were dispersed in the following amount, and thus, a first coating liquid was prepared. At this time, a sand mill was used as a disperser, and the dispersion was performed in a batch manner for 10 hours.

| | |
|---|---|
| Polyamide Resin | 1 part by mass |
| Titanium Oxide | 1.1 parts by mass |
| Ethanol | 20 parts by mass |

X1010 (manufactured by Daicel-Evonik Ltd.) was used as the polyamide resin (the resin binder), and SMT500SAS (manufactured by Tayca Corporation) was used as the titanium oxide (the conductive particles). A number average primary particle diameter of the titanium oxide is 0.035 μm.

The prepared first coating liquid was applied onto an outer peripheral surface of the conductive support by a dip coating method which was prepared, and was dried in an oven at 110° C. for 20 minutes. Accordingly, an interlayer having a film thickness of 2 μm was formed on the surface of the conductive support.

(3) Formation of Electric Charge Generating Layer

Next, components described below were mixed in the following amount, and were dispersed, and thus, a second coating liquid was prepared. At this time, a sand mill was used as a disperser, and the dispersion was performed for 10 hours.

| | |
|---|---|
| Titanyl Phthalocyanine Pigment | 20 parts by mass |
| Polyvinyl Butyral Resin | 10 parts by mass |
| t-Butyl Acetate | 700 parts by mass |
| 4-Methoxy-4-Methyl-2-Pentanone | 300 parts by mass |

The titanyl phthalocyanine pigment (the electric charge generating substance) has a maximum diffraction peak at least in a position of 27.3° in the measurement of an X-ray diffraction spectrum having Cu-Kα properties. In addition, #6000-C (manufactured by Denka Company Limited) was used as the polyvinyl butyral resin (the resin binder).

The prepared second coating liquid was applied onto the interlayer by a dip coating method, and was dried in the oven at a room temperature for 10 minutes. Accordingly, an electric charge generating layer having a film thickness of 0.3 μm was formed the surface of the interlayer.

(4) Formation of Electric Charge Transport Layer

Components described below were mixed in the in the following amount, and were dissolved, and thus, a third coating liquid was prepared.

| | |
|---|---|
| Electric Charge Transport Substance | 70 parts by mass |
| Resin Binder | 100 parts by mass |
| Antioxidant | 8 parts by mass |
| Tetrahydrofuran/Toluene (a mass ratio of 8/2) | 750 parts by mass |

4-methoxy-4'-(4-methyl-α-phenyl styryl) triphenyl amine was used as the electric charge transport substance. Bisphenol Z type polycarbonate (Iupilon-Z300; manufactured by Mitsubishi Gas Chemical Company, Inc.) was used as the resin binder for the electric charge transport layer. Irganox1010 (manufactured by BASF SE; "Irganox" is a registered trademark of the company) was used as the antioxidant.

The prepared third coating liquid was applied onto the electric charge generating layer by a dip coating method, and was dried in the oven at 120° C. for 70 minutes. Accordingly, an electric charge transport layer having a film thickness of 20 μm was formed the surface of the electric charge generating layer.

(4) Formation of Surface Layer

Components described below were uses as the components of the fourth coating liquid.

| | |
|---|---|
| Resin Binder | 100 parts by mass |
| Polymerization Initiator | 10 parts by mass |
| Conductive Particles A | 70 parts by mass |
| Conductive Particles B | 30 parts by mass |
| Tetrahydrofuran/2-Butanol (a mass ratio of 10/1) | 440 parts by mass |

Trimethylol propane trimethacrylate (SR350; manufactured by Sartomer Japan Inc.) was used as the resin binder for the surface layer (the polyfunctional radical polymerizable compound). A photopolymerization initiator (Irgacure819; manufactured by BASF Japan Ltd.) was used as the polymerization initiator. Tin oxide ($SnO_2$; an average particle diameter of 100 nm) which was subjected to a surface treatment was used as the conductive particles A. In addition, tin oxide ($SnO_2$; an average particle diameter of 20 nm) which was subjected to a surface treatment was used as the conductive particles B.

The conductive particles A ($SnO_2$) were added to methanol, and dispersion was performed for 30 minutes by using a US homogenizer. Next, 3-methacryloxy propyl trimethoxy silane (KBM503; manufactured by Shin-Etsu Chemical Co., Ltd.) as a coupling agent and toluene were added, and stirring was performed at a room temperature for 1 hour. Further, a solvent was removed by an evaporator, and then, heating was performed at 120° C. for 1 hour, and thus, the conductive particles A which was subjected to the surface treatment with the coupling agent were prepared. Furthermore, in the conductive particles A which were subjected to the surface treatment, shown in Tables 2 and 3 described below, the volume resistance was adjusted by adjusting a formulation amount of methanol, $SnO_2$, the coupling agent, and toluene. As with the conductive particles A which were subjected to the surface treatment, except that the conductive particles A were changed to the conductive particles B, the conductive particles B which were subjected to the surface treatment, shown in Tables 2 and 3 described below, were prepared.

50 parts of the conductive particles A, 50 parts of the conductive particles B, 100 parts of the resin binder for the surface layer, and 440 parts of tetrahydrofuran/2-butanol (a mass ratio of 10/1) were mixed under a light-shielded condition, and were dispersed for 5 hours by using a sand mill as a disperser. Next, 10 parts of the polymerization initiator was added, and was dissolved by being stirred was performed under a light-shielded condition, and thus, a fourth coating liquid was prepared.

The fourth coating liquid was applied onto the outer peripheral surface of the conductive support on which the electric charge transport layer is formed by using a circular slide hopper coating device, and then, was irradiated with an ultraviolet ray for 1 minute by using a metal halide lamp. Accordingly, a surface layer having a film thickness of 3.0 μm was formed on the surface of the electric charge transport layer.

<Preparation of Photoreceptors of Nos. 2 to 12, 14 to 16, and 19 to 24>

Photoreceptors of Nos. 2 to 12, 14 to 16, and 19 to 24 were obtained by the same method as that of the photoreceptor of No. 1 except that the conductive particles A having physical properties shown in Tables 2 and 3 and the conductive particles B having physical properties shown in Tables 2 and 3 were formulated in the amount shown in Tables 2 and 3.

<Preparation of Photoreceptor of No. 13>

A photoreceptor of No. 13 was obtained by the same method as that of the photoreceptor of No. 1 except that the conductive particles A and the conductive particles B, which were not treated with a surfactant, were formulated in the amount shown in Tables 2 and 3.

<Preparation of Photoreceptor of No. 17>

A photoreceptor of No. 17 was obtained by the same method as that of the photoreceptor of No. 1 except that the conductive particles B were not formulated, and the conductive particles A were formulated in the amount shown in Tables 2 and 3.

<Preparation of Photoreceptor of No. 18>

A photoreceptor of No. 18 was obtained by the same method as that of the photoreceptor of No. 1 except that the conductive particles A were not formulated, and the conductive particles B were formulated in the amount shown in Tables 2 and 3.

Physical property values of each of the conductive particles A used for preparing the photoreceptors of No. 1 to No. 24, and physical property values and surfactants of each of the conductive particles B are shown in Tables 2 and 3.

TABLE 2

| | | Conductive Particles A | | | | Conductive Particles B | | | |
|---|---|---|---|---|---|---|---|---|---|
| Classification | Photo-receptor No. | Type | Particle Diameter (μm) | Powder Resistance (Ω cm) | Number Density (items/μm$^3$) | Type | Particle Diameter (μm) | Powder Resistance (Ω cm) | Number Density (items/μm$^3$) |
| Example | 1 | $SnO_2$ | 100 | $6.4 \times 10^3$ | 23 | $SnO_2$ | 20 | $5.6 \times 10^7$ | 2900 |
| | 2 | $SnO_2$ | 100 | $6.4 \times 10^3$ | 34 | $SnO_2$ | 20 | $5.6 \times 10^7$ | 4200 |
| | 3 | $SnO_2$ | 100 | $6.4 \times 10^2$ | 15 | $SnO_2$ | 20 | $5.6 \times 10^7$ | 1800 |
| | 4 | $SnO_2$ | 200 | $4.2 \times 10^1$ | 2 | $SnO_2$ | 30 | $6.3 \times 10^7$ | 800 |
| | 5 | $SnO_2$ | 100 | $2.3 \times 10^3$ | 23 | $SnO_2$ | 10 | $3.1 \times 10^8$ | 23500 |
| | 6 | $SnO_2$ | 100 | $6.4 \times 10^3$ | 23 | $SnO_2$ | 20 | $5.6 \times 10^7$ | 2900 |
| | 7 | $SnO_2$ | 100 | $6.4 \times 10^3$ | 23 | $SnO_2$ | 20 | $5.6 \times 10^7$ | 2900 |
| | 8 | $SnO_2$ | 200 | $4.2 \times 10^1$ | 1 | $SnO_2$ | 30 | $6.3 \times 10^7$ | 125 |
| | 9 | $SnO_2$ | 80 | $6.4 \times 10^3$ | 130 | $SnO_2$ | 10 | $3.1 \times 10^8$ | 35000 |
| | 10 | $SnO_2$ | 100 | $6.4 \times 10^3$ | 43 | $SnO_2$ | 30 | $5.6 \times 10^7$ | 50 |
| | 11 | $SnO_2$ | 100 | $6.4 \times 10^3$ | 23 | $SnO_2$ | 20 | $5.6 \times 10^7$ | 2900 |
| | 12 | $SnO_2$ | 100 | $6.4 \times 10^3$ | 23 | $SnO_2$ | 10 | $5.6 \times 10^7$ | 80000 |
| | 13 | $SnO_2$ | 100 | 2.5.E+02 | 23 | $SnO_2$ | 20 | $4.3 \times 10^5$ | 2900 |
| Comparative Example | 14 | $SnO_2$ | 300 | $9.5 \times 10^2$ | 1 | $SnO_2$ | 20 | $5.6 \times 10^7$ | 4100 |
| | 15 | $SnO_2$ | 50 | $6.7 \times 10^2$ | 160 | $SnO_2$ | 20 | $5.6 \times 10^7$ | 4100 |
| | 16 | $SnO_2$ | 100 | $4.2 \times 10^1$ | 23 | $SnO_2$ | 60 | $5.1 \times 10^8$ | 100 |
| | 17 | $SnO_2$ | 100 | $6.4 \times 10^3$ | 46 | — | — | — | — |
| | 18 | — | — | — | — | $SnO_2$ | 20 | $5.6 \times 10^7$ | 5800 |
| | 19 | $SnO_2$ | 100 | $4.2 \times 10^1$ | 14 | $SnO_2$ | 10 | $2.9 \times 10^1$ | 35000 |
| | 20 | Al2O3 | 100 | $4.7 \times 10^{11}$ | 23 | $SnO_2$ | 20 | $5.6 \times 10^7$ | 2900 |
| | 21 | $SnO_2$ | 100 | $7.9 \times 10^{10}$ | 23 | $SnO_2$ | 20 | $5.6 \times 10^7$ | 2900 |
| | 22 | $SnO_2$ | 100 | $3.2 \times 10^0$ | 23 | $SnO_2$ | 20 | $5.6 \times 10^7$ | 2900 |
| | 23 | $SnO_2$ | 100 | $6.4 \times 10^3$ | 23 | $SnO_2$ | 50 | $2.9 \times 10^9$ | 160 |
| | 24 | $SnO_2$ | 100 | $6.4 \times 10^3$ | 15 | $SnO_2$ | 3 | $2.9 \times 10^9$ | 570000 |

TABLE 3

| | | | | | | Formulation Amount (parts by mass) | | |
|---|---|---|---|---|---|---|---|---|
| Classification | Photo-receptor No. | Film Thickness (μm) | Surfactant | 4 × d2 | 20 × d2 | Conductive Particles A | Conductive Particles B | Total |
| Example | 1 | 3 | KBM503 | 80 | 400 | 50 | 50 | 100 |
| | 2 | 3 | KBM503 | 80 | 400 | 125 | 125 | 250 |
| | 3 | 3 | KBM503 | 80 | 400 | 25 | 25 | 50 |
| | 4 | 3 | KBM503 | 120 | 600 | 30 | 70 | 100 |
| | 5 | 3 | KBM503 | 40 | 200 | 50 | 50 | 100 |
| | 6 | 5 | KBM503 | 80 | 400 | 50 | 50 | 100 |
| | 7 | 1.5 | KBM503 | 80 | 400 | 50 | 50 | 100 |
| | 8 | 3 | KBM503 | 120 | 600 | 40 | 10 | 50 |
| | 9 | 3 | KBM503 | 40 | 400 | 200 | 50 | 250 |
| | 10 | 3 | KBM503 | 120 | 600 | 90 | 10 | 100 |
| | 11 | 6 | KBM503 | 80 | 400 | 50 | 50 | 100 |
| | 12 | 3 | KBM503 | 80 | 400 | 50 | 300 | 350 |
| | 13 | 3 | — | 80 | 400 | 50 | 50 | 100 |
| Comparative Example | 14 | 3 | KBM503 | 80 | 400 | 30 | 70 | 100 |
| | 15 | 3 | KBM503 | 80 | 400 | 30 | 70 | 100 |
| | 16 | 3 | KBM503 | 240 | 1200 | 50 | 50 | 100 |
| | 17 | 3 | KBM503 | — | — | 100 | 0 | 100 |

TABLE 3-continued

| Classification | Photo-receptor No. | Film Thickness (μm) | Surfactant | 4 × d2 | 20 × d2 | Formulation Amount (parts by mass) Conductive Particles A | Conductive Particles B | Total |
|---|---|---|---|---|---|---|---|---|
| | 18 | 3 | KBM503 | — | — | 0 | 100 | 100 |
| | 19 | 3 | KBM503 | 20 | 100 | 30 | 70 | 100 |
| | 20 | 3 | KBM503 | 80 | 400 | 50 | 50 | 100 |
| | 21 | 3 | KBM503 | 80 | 400 | 50 | 50 | 100 |
| | 22 | 3 | KBM503 | 80 | 400 | 50 | 50 | 100 |
| | 23 | 3 | KBM503 | 200 | 1000 | 50 | 50 | 100 |
| | 24 | 3 | KBM503 | 200 | 1000 | 30 | 20 | 50 |

2. Evaluation of Photoreceptor

In the photoreceptors of Nos. 1 to 24, abrasion resistance, electrical properties, and cleaning properties were evaluated.

(1) Evaluation of Abrasion Resistance

The photoreceptors of Nos. 1 to 24 were respectively mounted on a modified cleaner of an image forming apparatus "Bizhub 368 (manufactured by Konica Minolta, Inc.)", 30000 sheets were printed in a black toner position under conditions of a temperature of 23° C. and humidity of 50%, and a decrease amount in a film thickness of the outermost layer of the photoreceptor was evaluated. Specifically, ten portions having approximately an even film thickness of the outermost layer (in this example, the surface layer) before and after 30000 sheets were printed were measured, and an average value thereof was set to the film thickness of the surface layer. Furthermore, the film thickness was measured by using a film thickness measuring instrument (EDDY560C; manufactured by Helmut Fischer GMBTE Co., Ltd.) of an eddy current method. In addition, in the portion having approximately an even film thickness, both end portions of the photoreceptor were obtained on the basis of a film thickness profile. Then, the photoreceptors of Nos. 1 to 24 were evaluated on the basis of the following criteria.

⊙: The abrasion is less than 0.3 μm (extremely excellent).

○: The abrasion is greater than or equal to 0.3 μm and less than 0.6 μm (excellent).

Δ: The abrasion is greater than or equal to 0.6 μm and less than 1.0 μm (there is no problem in practical use).

X: The abrasion is greater than or equal to 1.0 μm (there is a problem in practical use).

(2) Evaluation of Electrical Properties

The photoreceptors of Nos. 1 to 24 were respectively mounted on a modified cleaner of an image forming apparatus "Bizhub 368 (manufactured by Konica Minolta, Inc.)", an initial potential was set to 600±30 V, and a surface potential after exposure was measured, under conditions of a temperature of 23° C. and humidity of 50%. Then, the photoreceptors of Nos. 1 to 24 were evaluated on the basis of the following criteria.

⊙: The surface potential is less than or equal to 60 V (extremely excellent).

○: The surface potential is greater than 60 V and less than or equal to 90 V (excellent).

Δ: The surface potential is greater than 90 V and less than or equal to 120 V (there is no problem in practical use).

X: The surface potential is greater than 120 V (there is a problem in practical use).

(3) Evaluation of Dot Reproducibility

The photoreceptors of Nos. 1 to 24 were respectively mounted on a modified cleaner of an image forming apparatus "Bizhub 368 (manufactured by Konica Minolta, Inc.)", and one dot line was printed on white A4 paper under conditions of a temperature of 30° C. and humidity of 80%. Then, the photoreceptors of Nos. 1 to 24 were evaluated on the basis of the following criteria.

⊙: One dot line is stably and continuously reproduced (extremely excellent).

○: One dot line is stably reproduced, but there is a portion in which a line width of a part of the doe line is not even (excellent).

Δ: One dot line is thinly reproduced, but is not cut (practicable).

X: One dot line is reproduced by being cut (there is a problem in practicality).

In the photoreceptors of Nos. 1 to 24, classifications, photoreceptor numbers, evaluation results of the abrasion resistance, evaluation results of the electrical properties, and evaluation results of the dot reproducibility are shown in Table 4.

TABLE 4

| Classification | Photoreceptor No. | Evaluation Items Abrasion Resistance | Electrical Properties | Dot Reproducibility |
|---|---|---|---|---|
| Example | 1 | ⊙ | ⊙ | ⊙ |
| | 2 | ○ | ⊙ | ○ |
| | 3 | ⊙ | ○ | ○ |
| | 4 | ○ | ⊙ | ⊙ |
| | 5 | ⊙ | ⊙ | ⊙ |
| | 6 | ⊙ | ○ | ○ |
| | 7 | ⊙ | ⊙ | ⊙ |
| | 8 | ○ | ○ | ○ |
| | 9 | Δ | ○ | ⊙ |
| | 10 | ⊙ | Δ | Δ |
| | 11 | ⊙ | Δ | ○ |
| | 12 | Δ | ○ | ○ |
| | 13 | ○ | ⊙ | Δ |
| Comparative Example | 14 | ○ | ○ | X |
| | 15 | X | Δ | ○ |
| | 16 | X | ○ | ○ |
| | 17 | ○ | ○ | X |
| | 18 | X | Δ | ○ |
| | 19 | X | ⊙ | X |
| | 20 | ○ | X | X |
| | 21 | ⊙ | X | X |
| | 22 | Δ | ○ | X |
| | 23 | Δ | Δ | X |
| | 24 | X | X | Δ |

As shown in Table 4, in the photoreceptors of Nos. 14, 15, 23, and 24, the particle diameter d1 of the conductive particles A or the particle diameter d2 of the conductive particles B was in and out of a predetermined range, and thus, the abrasion resistance, the electrical properties, or the dot reproducibility were defective. In addition, in the photoreceptors of Nos. 19, 20, 21, and 22, the volume resistance ρ1 of the conductive particles A or the volume resistance ρ2 of the conductive particles B was out of a predetermined range, and thus, the abrasion resistance, the electrical properties, or the dot reproducibility were defective. In addition, in the photoreceptor of No. 17, only the conductive particles A were formulated as the conductive particles, and thus, the dot reproducibility was defective. It is considered that this is because the conductive particles B having a small particle diameter d2 are not contained in the photoreceptor, and thus, a distance in which the electric charge is moved lengthens, and a dot diameter increases. In addition, in the photoreceptor of No. 18, only the conductive particles B were formulated as the conductive particles, and thus, the abrasion resistance was defective. It is considered that this is because the conductive particles A having a large particle diameter d1 are not contained in the photoreceptor, and thus, there are a plurality of ground points due to the discharge.

In contrast, in the photoreceptors of Nos. 1 to 13, all of the abrasion resistance, the electrical properties, and the dot reproducibility were excellent. It is considered that this is because, in all of the photoreceptors of Nos. 1 to 14, the conductive particles A have the single peak in a range of 80 nm to 200 nm in the particle size distribution based on the number of particles and the volume resistance ρ1 in a range of $10^1$ Ωcm≤ρ1≤$10^4$ Ωcm, the conductive particles B have the single peak in a range of 10 nm to 30 nm in the particle size distribution based on the number of particles and the volume resistance ρ1 in a range of $10^6$ Ωcm<ρ2≤$10^9$ Ωcm, when the particle diameter of the conductive particles A is set to d1, and the particle diameter of the conductive particles B is set to d2, Expression (1) described above is satisfied, and when the volume resistance of the conductive particles A is set to ρ1, and the volume resistance of the conductive particles B is set to ρ2, Expression (2) described above is satisfied:

$$4\times d2\leq d1\leq 20\times d2 \quad (1)$$

$$10\times\rho1<\rho2 \quad (2)$$

According to the present invention, in the electrophotographic photoreceptor of the electrophotographic image forming apparatus, it is possible to increase abrasion resistance, scratch resistance, and cleaning properties, and to exhibit such properties over a long period of time. Accordingly, according to the present invention, higher durability and wider spread of the electrophotographic image forming apparatus are expected.

According to an embodiment of the present invention, it is possible to provide an electrophotographic photoreceptor which has excellent abrasion resistance and is capable of forming a high-quality image, and an image forming apparatus including the photoreceptor.

Although the present invention has been described and illustrated in detail, it is clearly understood that the same is by way of illustrated and example only and is not to be taken byway of limitation, the scope of the present invention being interpreted by terms of the appended claims.

What is claimed is:

1. An electrophotographic photoreceptor comprising:

a conductive support;

a photosensitive layer which is disposed on the conductive support and contains an electric charge generating material and an electric charge transport material; and a surface layer of the electrophotographic photoreceptor containing a resin binder, conductive particles A dispersed in the resin binder, and conductive particles B dispersed in the resin binder, the conductive particles A have a single peak in a range of 80 nm to 200 nm in a particle size distribution based on the number of particles and volume resistance ρ1 in a range of $10^1$ Ωcm≤ρ1<$10^4$ Ωcm, the conductive particles B have a single peak in a range of 10 nm to 30 nm in a particle size distribution based on the number of particles and volume resistance ρ2 in a range of $4.3\times10^5$ Ωcm≤ρ2≤$10^9$ Ωcm, when a particle diameter of the conductive particles A at the peak is set to d1, and a particle diameter of the conductive particles B at the peak is set to d2, Expression (1) described below is satisfied, and when the volume resistance of the conductive particles A is set to ρ1, and the volume resistance of the conductive particles B is set to ρ2, Expression (2) described below is satisfied:

$$4\times d2\leq d1\leq 20\times d2 \quad (1)$$

$$10\times\rho1<\rho2 \quad (2).$$

2. The electrophotographic photoreceptor according to claim 1, wherein a number density of the conductive particles A in the layer is in a range of 1 item/$\mu m^3$ to 150 items/$\mu m^3$, and a number density of the conductive particles B in the layer is in a range of 100 items/$\mu m^3$ to 70000 items/$\mu m^3$.

3. The electrophotographic photoreceptor according to claim 1, wherein both of the conductive particles A and the conductive particles B are $SnO_2$.

4. The electrophotographic photoreceptor according to claim 1, wherein a total formulation amount of the conductive particles A and the conductive particles B is in a range of 50 parts by mass to 250 parts by mass with respect to 100 parts by mass of the resin binder.

5. The electrophotographic photoreceptor according to claim 1, wherein the resin binder has a structure in which a polymerizable cured material is polymerized.

6. The electrophotographic photoreceptor according to claim 1, wherein the conductive particles A and the conductive particles B have a surface layer which comprises a residue of a surfactant having a crosslinkable reactive group.

7. The electrophotographic photoreceptor according to claim 1, wherein a thickness of the layer is in a range of 1.5 μm to 5.0 μm.

8. An image forming apparatus comprising:

the electrophotographic photoreceptor according to claim 1;

a charging device for charging the surface of the electrophotographic photoreceptor;

an exposing device for forming an electrostatic latent image by irradiating the charged surface of the electrophotographic photoreceptor with light;

a developing device for forming a toner image by supplying a toner onto the electrophotographic photoreceptor on which the electrostatic latent image is formed; and a transfer device for transferring the toner image on the surface of the electrophotographic photoreceptor onto a recording medium, wherein the charging device is a contact type charging device for applying a charged voltage by being in contact with the surface of the electrophotographic photoreceptor.

* * * * *